US006547591B2

(12) United States Patent
Okabe et al.

(10) Patent No.: US 6,547,591 B2
(45) Date of Patent: Apr. 15, 2003

(54) CONNECTOR HOLDING STRUCTURE FOR SECURELY MOUNTING PRINT-BOARD CONNECTOR IN CASING

(75) Inventors: Toshiaki Okabe, Shizuoka-ken (JP); Masahiro Noda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/822,247

(22) Filed: Apr. 2, 2001

(65) Prior Publication Data

US 2001/0027039 A1 Oct. 4, 2001

(30) Foreign Application Priority Data

Apr. 3, 2000 (JP) ..... 2000-101130

(51) Int. Cl.[7] ..... H01R 13/73
(52) U.S. Cl. ..... 439/557
(58) Field of Search ..... 439/76.1, 377, 439/157, 926, 79, 80, 354, 552, 557, 558, 357

(56) References Cited

U.S. PATENT DOCUMENTS

| | | | | | |
|---|---|---|---|---|---|
| 3,676,746 | A | * | 7/1972 | Kassabgi et al. | 317/101 |
| 3,998,518 | A | | 12/1976 | Mathe | |
| 4,541,036 | A | | 9/1985 | Landries et al. | |
| 5,049,092 | A | | 9/1991 | Takano et al. | |
| 5,096,439 | A | | 3/1992 | Arnett | |
| 5,199,900 | A | * | 4/1993 | Hayes, Sr. | 439/557 |
| 5,514,000 | A | * | 5/1996 | Krause et al. | 439/248 |
| 5,727,963 | A | * | 3/1998 | LeMaster | 439/385 |
| 5,779,500 | A | * | 7/1998 | Tokuwa et al. | 439/557 |
| 5,800,208 | A | * | 9/1998 | Ishizuka et al. | 439/557 |
| 5,975,930 | A | * | 11/1999 | Matsuura et al. | 439/157 |
| 6,033,241 | A | * | 3/2000 | Iwata et al. | 439/157 |
| 6,113,424 | A | * | 9/2000 | Shinozaki | 439/559 |
| 6,186,827 | B1 | * | 2/2001 | Okabe | 439/544 |
| 6,210,217 | B1 | * | 4/2001 | Ping | 439/557 |
| 6,241,551 | B1 | * | 6/2001 | Watanabe | 439/557 |

FOREIGN PATENT DOCUMENTS

| | | | |
|---|---|---|---|
| EP | 1081806 A1 | 3/2001 | H01R/13/74 |
| GB | 2 336 947 | 11/1999 | |
| GB | 2 366 671 A | 3/2002 | H01R/12/16 |
| JP | 49-15981 | 2/1974 | |
| JP | 11-167967 | 6/1999 | H01R/23/68 |
| WO | WO 98/13904 | 4/1998 | H01R/23/68 |

OTHER PUBLICATIONS

UK Search Report dated May 29, 2002.
UK Search Report dated Jul. 31, 2001.

* cited by examiner

*Primary Examiner*—Lynn D. Feild
*Assistant Examiner*—Thanh-Tam Le
(74) *Attorney, Agent, or Firm*—Finnegan, Henderson, Farabow, Garrett & Dunner, L.L.P.

(57) ABSTRACT

A connector holding structure is provided to securely hold a print-board connector loaded on a printed circuit board in a casing. The print-board connector includes a connector housing, which has a connector chamber for receiving a counterpart connector in its front portion. The casing has an opening that receives the front portion of the connector housing. The print-board connector has a lock arm and a stopper on at least one surface of the connector housing. The lock arm comes into engagement with the outer edge of the opening of the casing, and the stopper comes into contact with an inner face of the casing near an inner edge of the opening when the connector housing is fit into the opening. The lock arm comprises a flexible base portion extending in the direction of insertion of the connector housing, and a step formed at the trailing end of the base portion. The step catches the outer edge of the opening.

16 Claims, 7 Drawing Sheets

RRIOR ART

CONNECTOR HOLDING STRUCTURE FOR SECURELY MOUNTING PRINT-BOARD CONNECTOR IN CASING

BACKGROUND OF THE INVENTION

1. Field of the Invention

The present invention relates to a connector holding structure for securing a print-board connector mounted on a printed circuit board into a casing.

2. Description of the Related Art

FIG. 1 illustrates a conventional print-board connector 1, which is attached to a casing 2. The print-board connector 1 includes a connector housing 2 and L-shaped PCB (printed circuit board) terminals 3 extending out of the housing 2. The print-board connector 1 is fixed to a printed circuit board 4 by screws 5, and both the print-board connector 1 and the printed circuit board 4 are accommodated inside the casing 6.

The connector housing 2 has nut 7, which project from the bottom of the connector housing 2 to receive bolt 5. The nut 7 is formed monolithically with the connector housing 2. The PCB terminals 3 extending from the connector housing 2 are soldered to the printed circuit board 4. The casing 6 has an opening 8, and the print-board connector 1 is attached to the casing 6 so that the opening of the print board connector 1 aligns with the opening 8 of the casing 6. A male connector 10 coupled with, for example, the end of a wire harness 9, is fit into the print-board connector 1 through the opening 8.

In conventional connector structures, a relatively large force is required to fit the male connector 10 into the print-board connector 1 because multiple terminal jacks (not shown) extending in the male connector 10 must be connected to the PCB terminals 3 of the print-board connector 1 by one-to-one correspondence. Consequently, undesirable load is applied on the printed circuit board 4 via the print-board connector 1 during the insertion of the male connector 10, and stress is caused in the printed circuit board 1.

If an external force is accidentally applied to the print-board connector 1 in addition to the insertion force, the printed circuit board 4 may be damaged or warped, and electrical disconnection may be caused between the male connector 10 and the print-board connector 1.

Furthermore, the undesirable insertion force required for electrical connection between the male connector 10 and the print-board connector 1 limits the freedom of design, and prevents the print-board connector 1 from being designed as a so-called multipolar connector Still another problem is that screwing the print-board connector 1 onto the printed circuit board 4 is troublesome in the assembling process.

SUMMARY OF THE INVENTION

Therefore, it is an object of the invention to provide a connector holding structure that can absorb an undesirable insertion force and effectively reduce the stress in the printed circuit board during the insertion of a counterpart connector into a print-board connector. This structure is realized at a low manufacturing cost, and can guarantee a reliable electrical connection between two connectors.

In the first aspect of the invention, a connector holding structure comprises a a print-board connector loaded on a printed circuit board, and a casing accommodating the print-board connector and the printed circuit board. The print-board connector includes a connector housing that has a connector chamber in its front portion for receiving the counterpart connector. The casing has an opening for receiving the front portion of the connector housing. As a feature of the invention, the print-board connector has a lock arm and a stopper on at least one surface of the connector housing.

The lock arm comes into engagement with the outer edge of the opening, and the stopper comes into contact with the inner face of the casing near the inner edge of the opening when the connector housing is fit into the opening.

In this arrangement, the lock arm and the stopper catch the opening of the casing, and support the print-board connector against the casing in a secure manner, while preventing the printed circuit board from making contact with the casing. When the counterpart connector is fit into the print-board connector, the insertion force is absorbed into the casing via the lock arm and the stopper, and it does not affect the printed circuit board. Similarly, if the counterpart connector is removed from the print-board connector, the pulling force is absorbed by the wall of the casing, and the printed circuit board is protected from an excessive load or stress.

Preferably, the lock arm comprises a flexible base portion extending in the direction of insertion of the connector housing, and a step formed at the trailing end of the base portion. The step of the lock arm is engaged with the outer edge of the opening of the casing on full insertion. To be more precise, the base portion of the lock arm passes through the opening of the casing, while deforming, when the connector housing is fit into the opening. Once the base portion has passed through the opening, the step catches the outer edge of the opening.

The stopper is, for example, a rib or a set of (two or more) projections. On either case, the stopper has a sufficient contact area with the inner face of the casing. The sufficient mount of contact area allows the print-board connector to be held against the casing in a stable manner.

The print-board connector also has a positioning means on at least one surface (e.g., the top and/or the bottom face) of the connector housing. This positioning prevents the print-board connector from shifting from a correct position.

The print-board connector is loaded on the printed circuit board by means of a manner that a portion of the bottom face of the connector housing being attached onto the printed circuit board. Because the insertion force applied to the print-board connector is absorbed in the casing, the connector housing of the print-board connector can be, for example, bonded or soldered to the printed circuit board, without the need for screwing the print-board connector onto the printed circuit board. Consequently, the assembling process is facilitated.

The casing has a pair of guide ribs built into the inner faces of two opposite walls. The guide ribs receive the edges of the printed circuit board, and allow the printed circuit board to slide along the ribs in the direction of insertion of the print-board connector. This arrangement allows the insertion force to escape more effectively during the insertion of the counterpart connector.

In another aspect of the invention, a connector holding structure comprises a print-board connector loaded on a printed circuit board, a casing for accommodating the print-board connector and the printed circuit board, and a connector holder positioned inside the casing. The connector includes a connector housing that has a connector chamber in its front portion for receiving a counterpart connector. The casing also has a first opening for receiving the front end of the connector housing of the print-board connector. The connector holder has a second opening for receiving the connector housing of the print-board connector. The print-board connector has a lock arm and a stopper on at least one surface of the connector housing. The lock arm comes into engagement with the outer edge of the second opening, and the stopper comes into contact with the inner face of the connector holder near the inner edge of the second opening when the front end of the connector housing is fit into the first opening.

The connector holder is, for example, a wall extending in parallel to a plane containing the first opening of the casing. With this structure, the connector holder absorbs the insertion force, and it does not affect the printed circuit board. Consequently, the printed circuit board is protected from undesirable stress due to the insertion force.

BRIEF DESCRIPTION OF THE DRAWINGS

Other objects and advantages will be apparent from the following detailed description of the invention in conjunction with the attached drawings, in which.

DETAILED DESCRIPTION OF THE PREFERED EMBODIMENTS

The preferred embodiments of the connector holding structure will now be described in detail.

Figure 1:
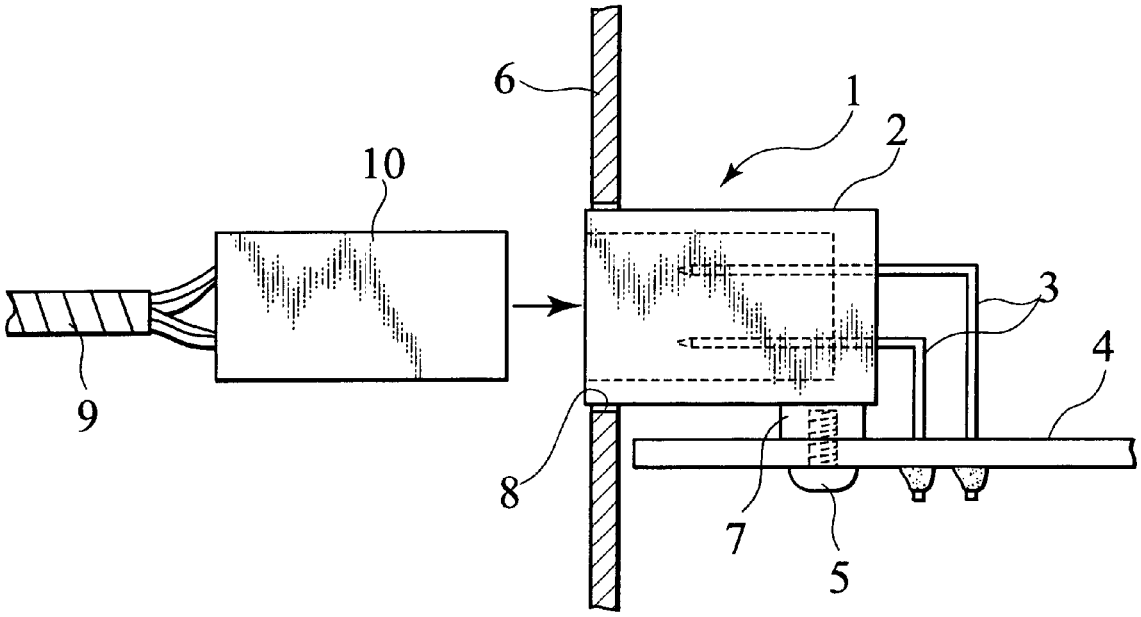
FIG. 1 illustrates a conventional print-board connector loaded on a printed circuit board and fixed in a casing.
Figure 2:
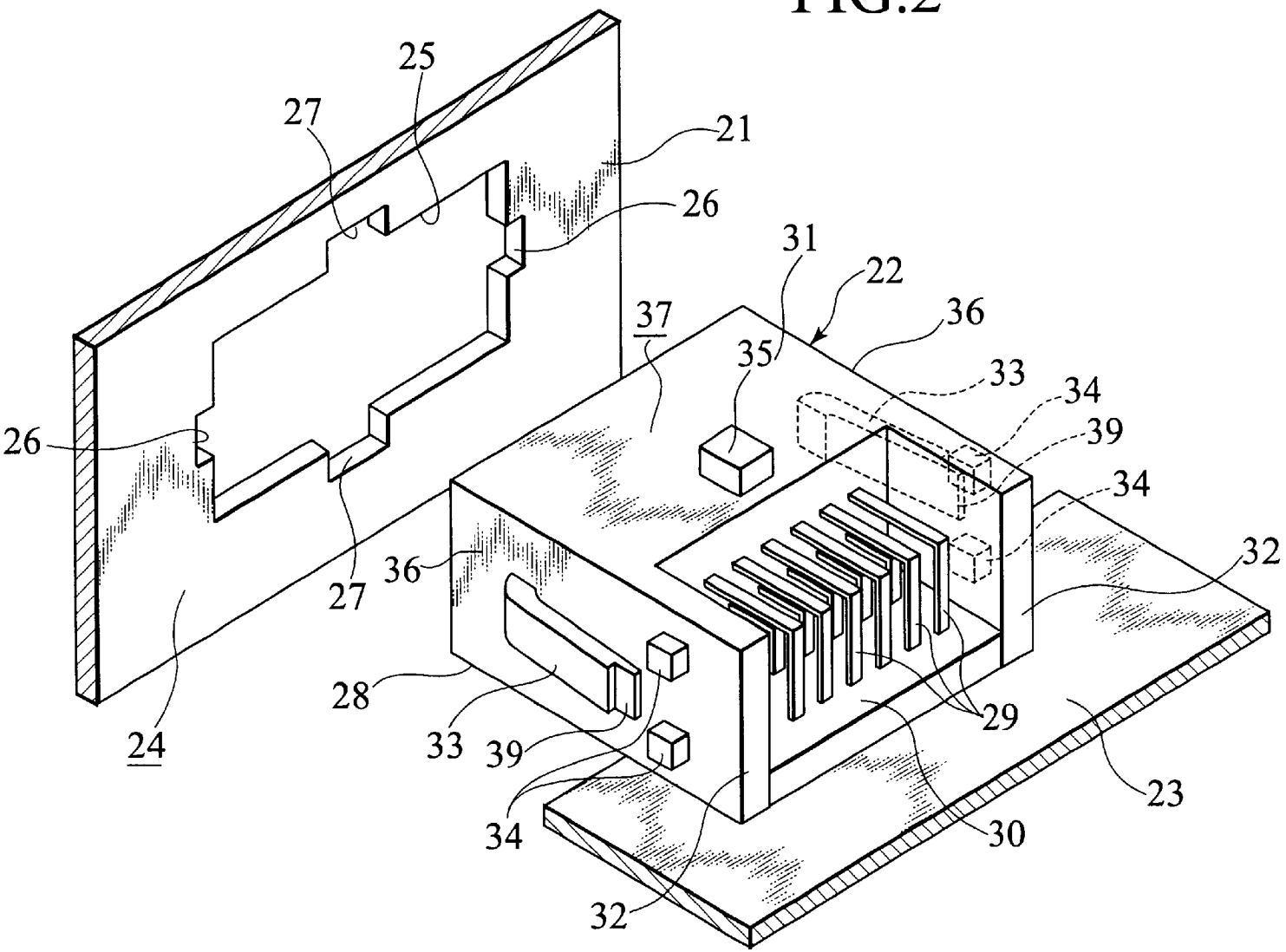
FIG. 2 illustrates in a perspective view a connector holding structure according to the first embodiment of the invention, which holds a print-board connector loaded on a printed circuit board in a casing without causing stress on the printed circuit board.
Figure 3:
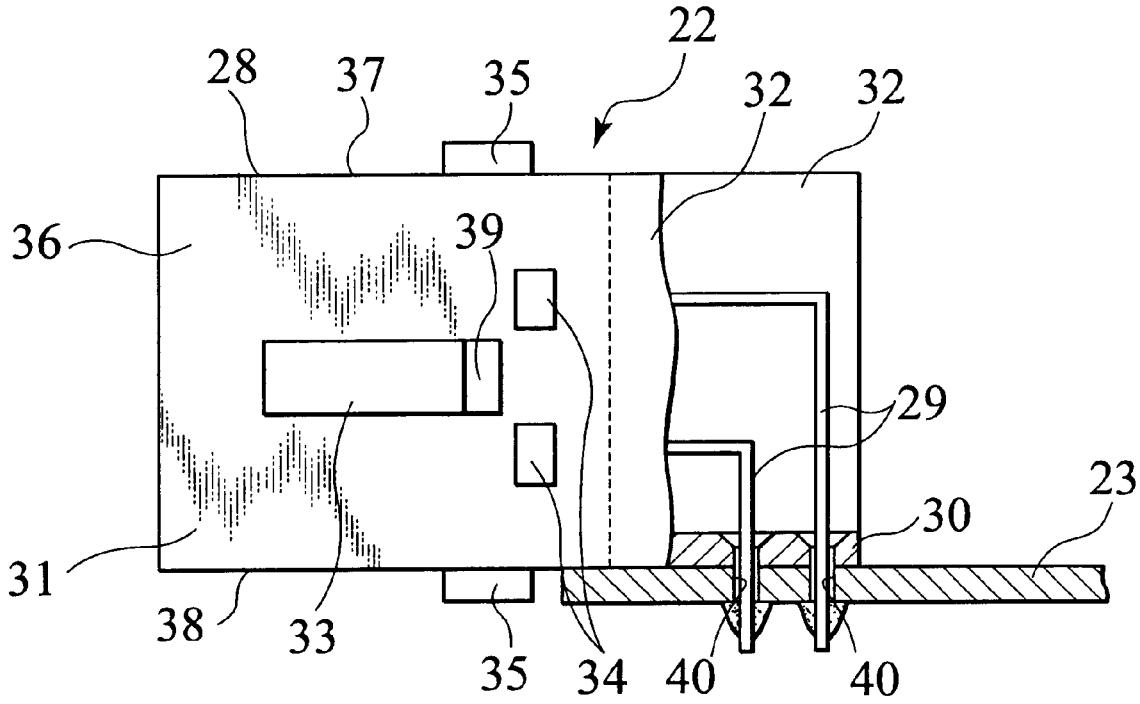
FIG. 3 is a side view of the print-board connector loaded on the printed circuit board shown in FIG. 2.

FIG. 2 illustrates a perspective view of a connector holding structure according to the first embodiment of the invention, and FIG. 3 illustrates a side view of the print-board connector loaded on the printed circuit board shown in FIG. 2.

A print-board connector 22 is fixed to a printed circuit board 23 and generally accommodated in casing 21 of an instrument loaded on a vehicle, e.g., an automobile. An opening 25 is formed in a wall 24 of the casing 21 so as to allow a counterpart connector to be fit into the print-board connector 22 accommodated in casing 21. The significant feature of the invention is that the force applied to the print-board connector 22 during the insertion of the counterpart connector does not affect the printed circuit board 23. This feature is realized because the connector holding structure of the invention allows the print-board connector 22 to be securely held at the opening 25 of the casing 21 in such a manner that the insertion force is absorbed into the casing, without affecting the printed circuit board. This feature will be explained in detail below.

The casing 21 is a box made of a synthetic resin or metal, in which the printed circuit board 23 and the print-board connector 22 loaded on the printed circuit board 23 are accommodated. In the example shown in FIG. 2, a rectangular opening 25 is formed in a wall 24 of the box-like casing 21. A pair of first indents 26 are formed in the middle of the shorter edges, and a pair of second indents 27 are formed in the middle of the longer edges of the opening 25. The first indents 26 are made shallower than the second indents 27. The first indents 26 are configured to receive lock arms 33 provided to the print-board connector 22, which will be explained below, and the second indents 27 are configured to receive projections 35 of the print-board connector 22, which will also be explained below. Accordingly, the width of the first indents 26 correspond to the width of lock arms 22, and the width of the second indents 27 correspond to the width of projections 35.

The print-board connector 22 comprises a connector housing 28 made of a synthetic resin, multiple PCB terminals 29, and a guide plate 30 for positioning the PCB terminals.

Figure 4:
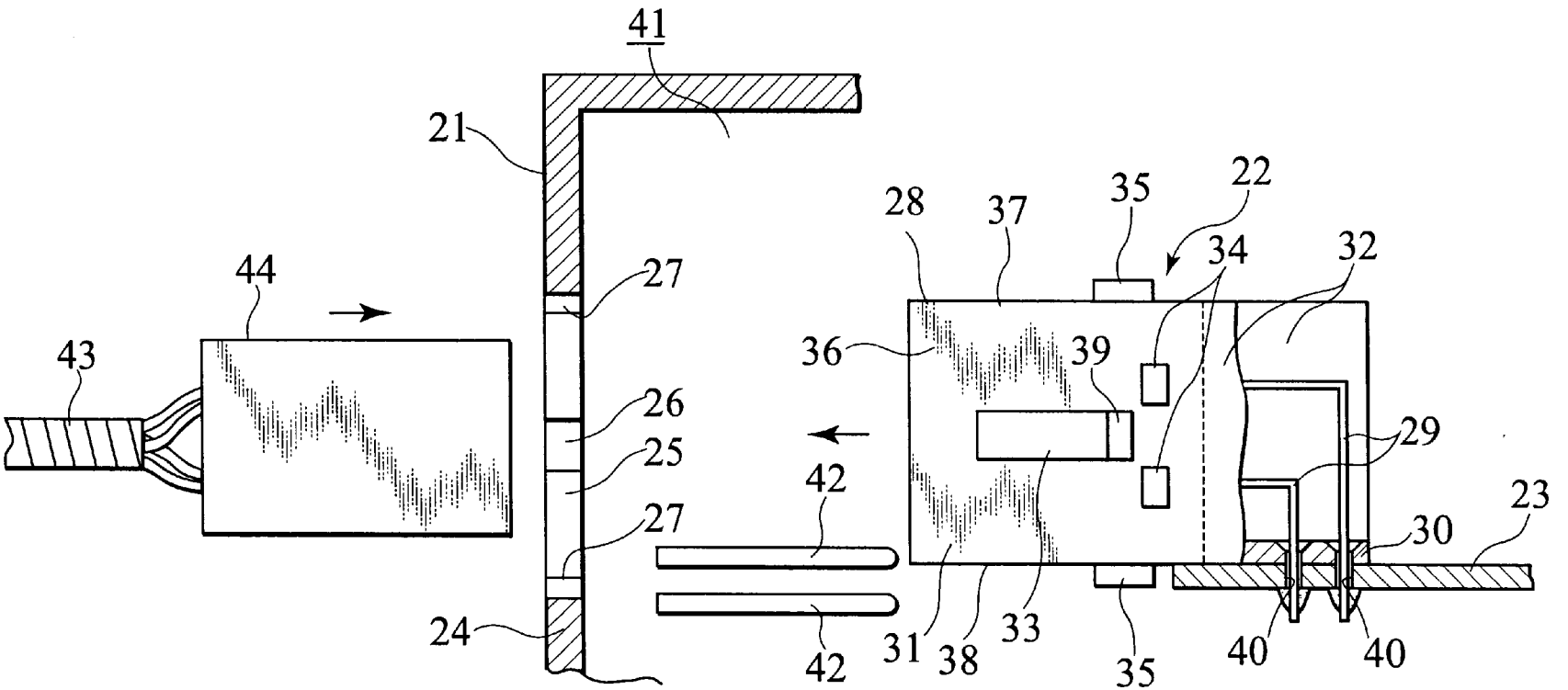
FIG. 4 is an exploded side view of the connector holding structure before the male connector is fit into the print-board connector.
Figure 5:
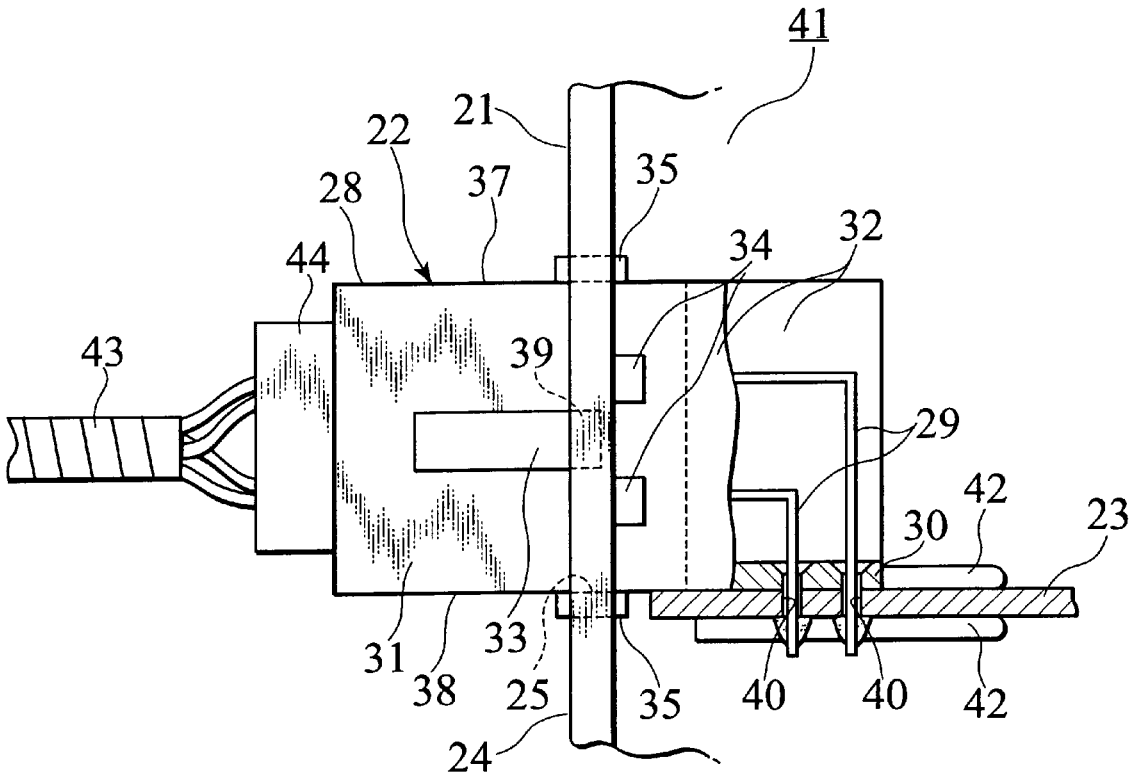
FIG. 5 is a side view of the print-board connector securing structure after the male connector has been fit into the print-board connector held in the casing.

The connector housing 28 has a connector chamber 31 in its front portion, which receives the counterpart connector 44 (shown in FIGS. 4 and 5). In this example, the connector chamber 31 is a female connector chamber. A pair of sidewalls 32 extend behind the female connector chamber 31, which protect the PCB terminals 29 projecting out of the rear wall of the female connector chamber 31. The sidewalls 32 have stoppers (not shown) on their inner faces in order to hold the guide plate 30 between the sidewalls 32.

The connector housing 28 has a pair of lock arms 33 and a pair of stoppers 34 on the outer faces of the two opposite walls 36. Positioning projections 35 are formed on the top and bottom faces 37 and 38 of the connector housing 28, as shown in FIG. 3. The lock arms 33, the stoppers 34, and the projections 35 are formed monolithically with the connector housing 28. The print-board connector 22 is loaded on the printed circuit board 23 in such a manner that a part of the bottom face 38 of the connector housing 28 is in contact with the printed circuit board 23.

The lock arms 33 extending along the walls 36 are elastic and flexible. Each lock arm 33 has a thick base portion and a step 39 extending toward the sidewall 32.

Stoppers 34 are positioned closer to the sidewall 32 than the step 39 of the lock arm 33. In this example, two stoppers 34 are formed on each wall 36 at a specified interval. However, the number of stoppers 34 and the space between the stoppers are not limited to this example, and three or more stoppers may be formed on each wall 36. Alternatively, a single rib extending in the vertical direction may be furnished as a stopper 34 to each wall 36, as long as a sufficient amount of contact area is obtained between the stopper and the wall 24 of the casing. In either case, it is preferable for the stopper 34 to have a larger contact area so that the print-board connector 22 is held in the opening 25 of the casing 21 with optimum reliability. The height of the stopper 34 is determined in accordance with the shape and the size of the opening 25 of the casing 21.

Positioning projections 35 are provided for purposes of preventing the print-board connector 22 from being shifted from the correct position. The positioning projections 35 are fit into the indents 27 of the opening 25, and keep the print-board connector at the correct position in a stable manner. Although, in this embodiment, two projections are provided to the connector housing, only a single projection may be formed either the top or the bottom face of the connector housing 28. Such positioning projections may be replaced with positioning grooves. In such a case, the opening 25 would have projections along its longer edges, instead of the indents 27, which would be received in the positioning grooves.

The bottom face 38 of the connector housing 28 is made flat, so that the print-board connector 22 is loaded on the printed circuit board 23 in a reliable manner.

The PCB terminals 29 are conductive metal strips. One end of the PCB terminal 29 is located inside the female connector chamber 31. The other end of the PCB terminal 29, which projects out of the rear face of the female connector chamber 31, is bent into an L-shape and guided by the guide plate 30 toward the rear face of the printed circuit board 23, as shown in FIG. 3. The other end is soldered to the rear face of the printed circuit board 23.

The printed circuit board 23 is made of an insulating synthetic resin, and has predetermined circuit patterns on its. One or more electronic devices or components are mounted on its flat surface. Multiple through-holes 40 are formed near the edges of the printed circuit board 23 so as to receive the PCB terminals 29 for electrical connection.

FIG. 4 illustrates how the counterpart male connector 44 is inserted in the print-board connector 22. Each of walls 41 that extend from the wall 24 and face each other has a pair of guide ribs 42 along the inner face. The guide ribs 42 extend in parallel to each other so as to hold the printed circuit board 23 in a slidable manner. In other words, the printed circuit board 23 does not have any means for fixing itself to the casing 21, and is held only by the guide ribs 42.

The print-board connector 22 is secured near the edge of the printed circuit board 23. To be more precise, the bottom face 38 of the connector housing 28 is brought into contact with the top face of the printed circuit board 23 with the PCB terminals 29 inserted into the through-holes 40 of the printed circuit board 23. As has been explained above, the PCB terminals 29 are then soldered to the rear face of the printed circuit board 23.

As illustrated in FIG. 4, the printed circuit board 23, on which the print-board connector 22 loaded, is guided into the casing 21 by the guide ribs 42, until the stoppers 34 hit the inner face of the wall 24 of the casing 21. In this state, the front portion of the connector housing 28 projects out of the opening 25 of the casing 21, as is illustrated in FIG. 5.

When the connector housing 28 is inserted through the opening 25, the flexible base-portions of the lock arms 33 deform and pass through indents 26 of the opening 25. Once the base portions of the lock arms 33 have passed through the indents 26, steps 39 of the lock arms 33 catch the edge of the indents 26. At this time, the stoppers 34 strike the inner face of the wall 24 near the indents 26. In this manner, the print-board connector 22 is securely held against the wall 24 of the casing 21.

When connecting the counterpart connector 44 coupled with the wire harness 43 to the print-board connector 22, the counterpart connector 44 is fit into the female connector chamber 31. The insertion force applied to the print-board connector 22 is transferred to the steps 39 of the lock arm 33, and then absorbed by the wall 24 from the indents 26, with which the steps 39 of the lock arms 33 are engaged. Accordingly, the insertion force applied to the print-board connector 22 will not causes stress in the printed circuit board 23, and electrical connection between the counterpart connector 44 and the print-board connector 22 is guaranteed.

Even if the insertion force is so great that the wall 24 of the casing 21 deforms, the insertion force is released without affecting the printed circuit board 23 because the printed circuit board 23 itself can slide along the guide ribs 42 in the direction of insertion. Accordingly, the soldered portions of the printed circuit board 23 are protected from stress.

To remove the counterpart connector 44 from the print-board connector 22, a pulling force is applied to the print-board connector 22 opposite to the insertion direction. In this case, the stoppers 34 butt against the wall 24 of the casing 21, and the pulling force is again absorbed by wall 24. Accordingly, the printed circuit board 23 is protected from stress.

Since the print-board connector 22 is loaded on the printed circuit board 23 via a direct contact between the bottom face of the connector housing 28 and the top face of the printed circuit board 23, screws used in the conventional art are no longer required.

The number of components of the print-board connector 22 is reduced, and the assembling process can be facilitated, while reducing the manufacturing cost.

Figure 6:
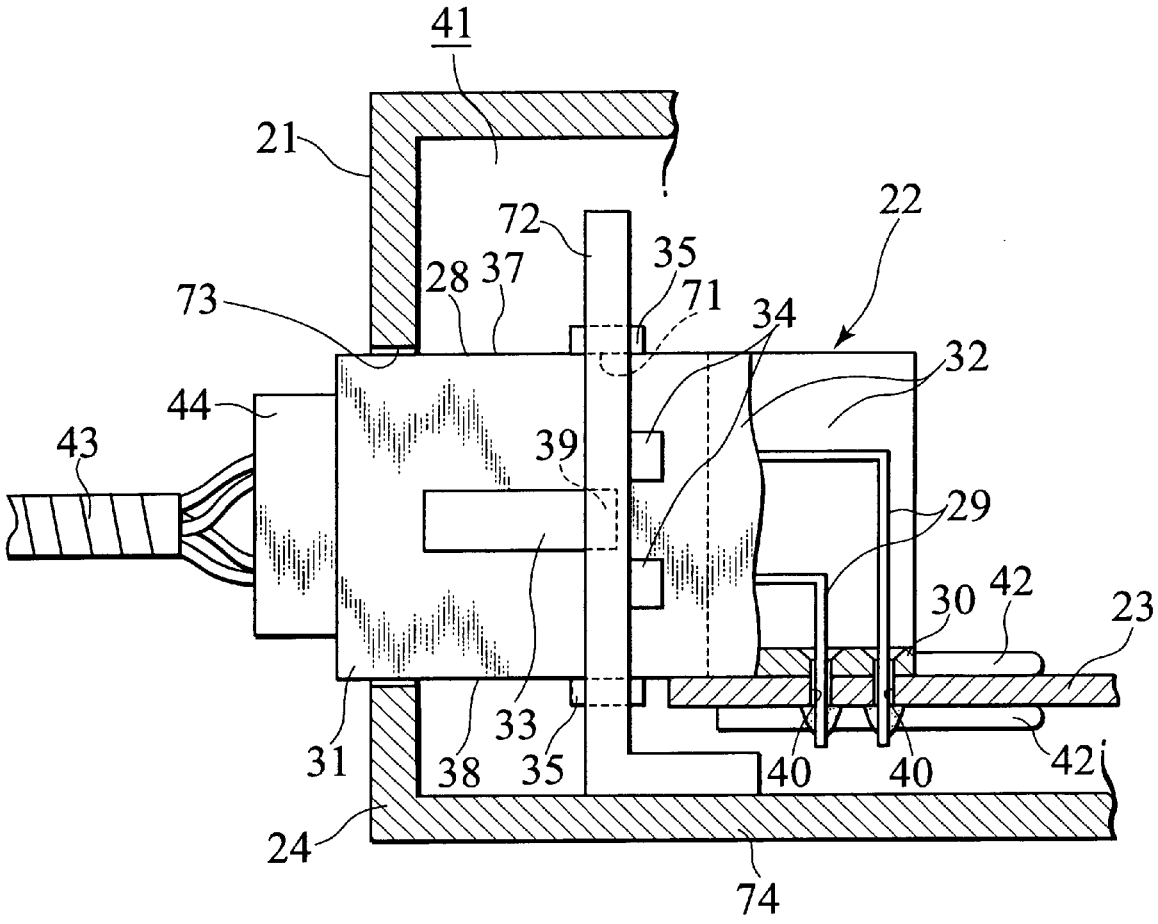
FIG. 6 illustrates a modification of the connector holding structure show in FIG. 2.

FIG. 6 illustrates a modification of the connector holding structure shown in FIGS. 2 through 5. In this modification, a connector holder 72 having an opening 71 is furnished in the casing 21. The connector holder 72 is, for example, a vertical wall with the opening 71. The print-board connector 22 fixed to the printed circuit board 23 is fit into the opening 71 of the connector holder 72.

The wall 24 of the casing 21 has an opening 73 shaped in a rectangle so as to correspond to the contour of the female connector chamber 31 of the print-board connector 22.

The connector holder 72 is fixed to, for example, the bottom 74 of the casing 21 by an appropriate means, and positioned in parallel to the wall 24 of the casing 21.

When inserting the print-board connector 22, together with the printed circuit board 23, into casing 21, the guide ribs 42 guide the printed circuit board 23 toward connector holder 72. Then, the connector housing 28 of the print-board connector 22 is fit into the opening 71 of the connector holder 72 until the stoppers 34 strike the rear face of the connector holder 72. At this time, the lock arms 33 have passed through the opening 71 and the steps 39 of the lock arms 33 catch the edges of the opening 71. The connector holder 72 secures the print-board connector 22, while the front end of the 25 connector housing 28 of the print-board connector 22 is aligned with opening 73 of casing 21. The counterpart connector 44 is then fit into the print-board connector 22.

With the modification, the connector holder or the vertical wall 72 absorbs the insertion force, and the printed circuit board 23 is protected from an excessive amount of stress due to the insertion.

Figure 7:
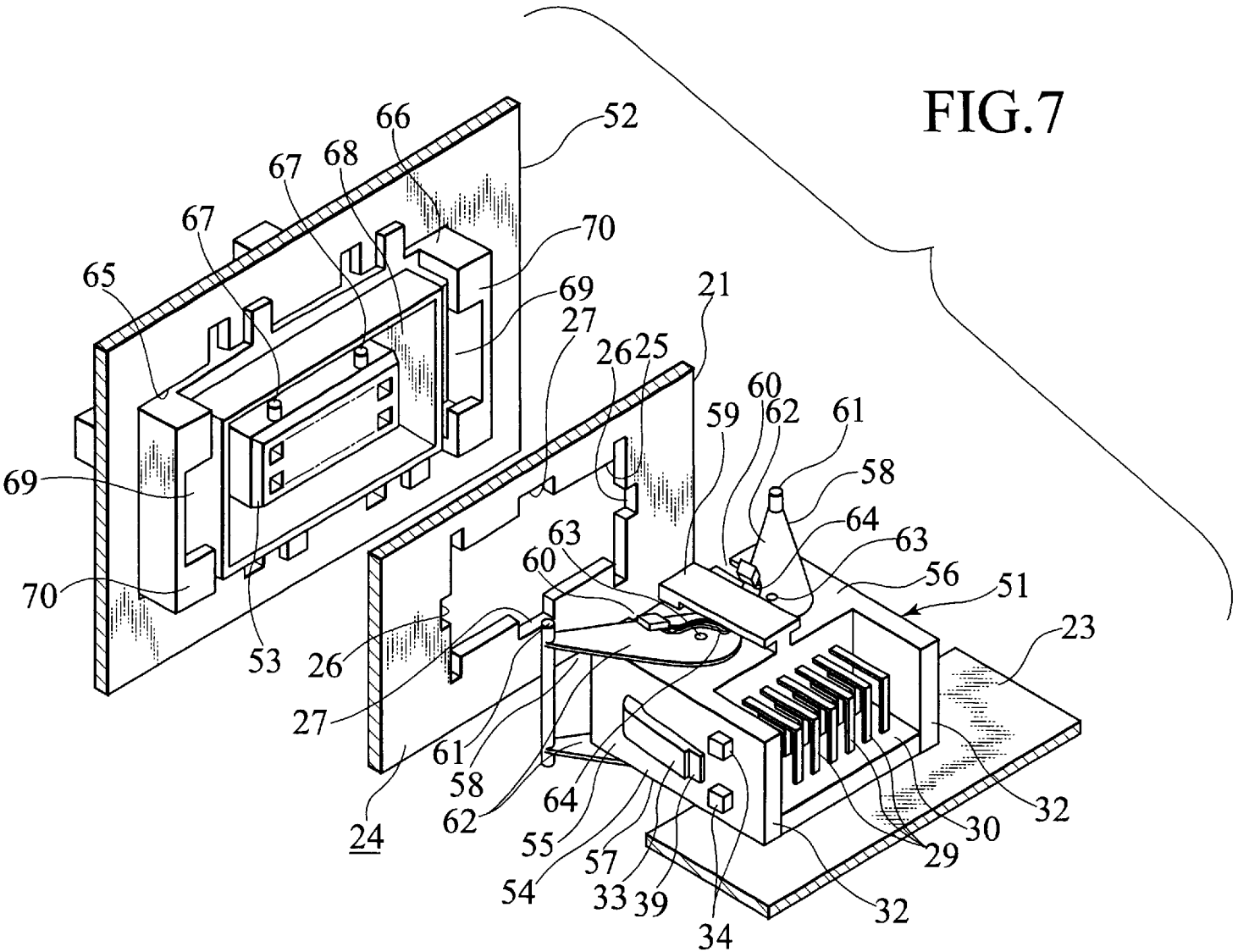
FIG. 7 illustrates a connector holding structure according to another embodiment of the invention, which has an LIF (low insertion force) mechanism for further reducing the load on the printed circuit board.

FIG. 7 illustrates a connector holding structure of the second embodiment, which has a low insertion force mechanism. The same elements as those illustrated in the first embodiment are denoted by the same numerical references, and the explanation for them will be omitted.

The print-board connector 51 comprises a connector housing 54 made of a synthetic resin, multiple PCB terminals 29 extending out of the connector housing 54, and a guide plate 30 for positioning the PCB terminals 29. As in the first embodiment, the connector housing 54 has a female connector chamber 55 in its front portion, as in the first embodiment. Sidewalls 32 extend behind the female connector chamber 55, between which guide plate 30 is held.

Lock arms 33 and stoppers 34 are formed monolithically with the connector housing 54. The lock arms 33 and the stoppers 34 allow the print-board connector 51 to be held firmly against the wall 24 of the casing 21. One of the features of the second embodiment is that pair of levers 58 are provided to the connector housing 54. Each lever 58 consists of a stick 61 and a pair of operation wings 62 extending from both ends of the stick 61 toward the top and the bottom faces 56 and 57of the connector housing 54. The lever 58 pivots about the pivot shaft 63 that penetrates the operation wings 62.

Positioning pieces 59 (one of them is illustrated in FIG. 6) are formed on the top and bottom faces 56 and 57 of the connector housing 54. The positioning pieces 59 are fit into indents 27 of the opening 25 of the wall 21, and prevent the print-board connector 51 from shifting from the correct position. Guide grooves 60 are also formed in the top and bottom faces 56 and 57 of the connector housing 54. The guide grooves 60 allow the counterpart connector 53 to be smoothly introduced into the print-board connector 51.

The operation wings 62 of the lever 58 have cam grooves 64, which correspond to the guide grooves 60 of the connector housing 54. Each cam groove 64 consists of both a straight and a curved portion.

The counterpart connector 53 is held via bracket holders 66 at the opening 65 formed in the instrument panel 52. The counterpart connector 53 has pins 67 projecting perpendicular to the direction of insertion. The pins 67 are received by the guide grooves 60 of the print-board connector 51 and the cam grooves 64 of the levers 58. There is a gap 68 formed around the counterpart connector 53 to receive the front portion of the connector housing 54 of the print-board connector 51.

Bracket holder 66 has stopper frames 70, which define recesses 69 on either side of the counterpart connector 53. If the counterpart connector 53 is fit into the print-board connector 51, sticks 61 of levers 58 enter the associated recesses 69, and move in the recesses 69 with both ends butting against the top and bottom faces of the recess 69. The stopper frame 70 keeps the stick 61 inside the recess 69. As the sticks 61 of the levers 58 slide in the recesses 69, the levers 58 pivot around the pivot axis 63.

With the pivoting of levers 58, the print-board connector 51 and the counterpart connector 53 are attracted to each other during the insertion. To be more precise, pins 67 of the counterpart connector 53 are first brought to the very ends of the guide grooves 60 and the cam grooves 64 of the levers 58. Then, the sticks 61 of the levers 58 are drawn into the recesses 69 of the counterpart connector 53. As the sticks 61 slide into the recesses 69, the levers 58 pivot, and the pins 67 of the counterpart connector 53 are introduced in the associated cam grooves 64 of the levers 58. In this manner, the counterpart connector 53 and the print-board connector 51 are attracted to each other even under a low insertion force.

Thus, the levers 58 of the print-board connector 51, the pins 67 of the counterpart connector 53, and the bracket holders 69 comprise an LIF (low insertion force) mechanism. This arrangement can further prevent the stress on the printed circuit board 23 during the insertion of the counterpart connector.

As has been described above, the lock arms and the stoppers of the connector housing allow the print-board connector to be securely held in the opening of the casing, while releasing the insertion force through the wall of the casing. Consequently, undesirable load or stress on the printed circuit board is effectively reduced, and electrical connection between two connectors can be guaranteed.

By using a separate connector holder or a vertical wall in the casing, the print-board connector is supported by the connector holder in the casing with the opening of the female connector chamber aligned with the opening of the casing. With this structure, the insertion force applied to the print-board connector is released into the connector holder or the vertical wall, and does not affect the printed circuit board.

If the stoppers are ribs or two or more projections, the overall contact area between the stoppers and the wall increases. This arrangement guarantees the secure engagement between the print-board connector and the opening of the casing.

The positioning pieces (projections or grooves) keeps the print-board connector at the correct position, and allows the amount of deformation of the lock arms to be fixed large without concern about offsetting or displacing of the print-board connector.

The print-board connector is loaded on the printed circuit board via a surface contact without using screws. The number of components and the number of assembling steps are reduced, which leads to the reduction of manufacturing cost, while improving work efficiency.

The guide ribs formed in the inner wall of the casing allow the printed circuit board to slide in the direction of insertion. This arrangement allows the insertion force and the disconnection force to be absorbed in the sliding direction when the counterpart connector is connected to or disconnected from the print-board connector.

Although the invention has been described based on the preferred embodiments, the invention is not limited to these examples and many changes and substitutions are possible without departing from the scope of the invention, which is defined by the appended claims.

What is claimed is:

1. A connector holding structure comprising:

a print-board connector loaded on a printed circuit board, the print-board connector including a connector housing having a connector chamber for receiving a counterpart connector in its front portion, the print-board connector having at least two lock arms and at least one stopper associated with each of the at least two lock arms, the at least two lock arms each having a base portion on the connector housing and a trailing end; and a casing for accommodating the print-board connector and the printed circuit board, the casing having an opening for receiving the front portion of the connector housing, the opening having at least one indent located along a periphery of the opening, the at least two lock arms each configured so that, during insertion of the connector housing into the casing, the base portion engages an outer edge of the at least one indent before the trailing end, and the at least one stopper configured to contact with an inner face of the casing near an inner edge of the at least one indent when the connector housing is fit into the opening, the print-board connector configured to engage with the casing without substantial rotational movement during mating of the print-board connector with the casing.

2. The connector holding structure of claim 1, wherein the at least two lock arms each comprise a flexible base portion extending in the direction of insertion of the connector housing, and a step formed at the trailing end of the base portion, the step catching the outer edge of the indent.

3. The connector holding structure of claim 1, wherein the at least one stopper comprises two or more projections, each having a contact area that comes into contact with the inner face of the casing.

4. The connector holding structure of claim 1, wherein the at least one stopper comprises a rib having a contact area that comes into contact with the inner face of the casing.

5. The connector holding structure of claim 1, further comprising a positioning means on at least one surface of the connector housing, the positioning means preventing the print-board connector from shifting from a correct position.

6. The connector holding structure of claim 1, wherein the print-board connector is loaded on the printed circuit board in such a manner that a portion of the bottom face of the connector housing is mounted on the printed circuit board.

7. The connector holding structure of claim 1, wherein the casing has a pair of guide ribs in the inner faces of two opposite walls, and the printed circuit board slides along the guide ribs in the direction of insertion of the print-board connector.

8. A connector holding structure comprising:

a print-board connector loaded on a printed circuit board, the print-board connector including a connector housing having a connector chamber for receiving a counterpart connector at its front portion; and a casing for accommodating the print-board connector and the printed circuit board, the casing having a first opening for receiving a front end of the connector housing of the print-board connector, and a connector holder inside the casing, the connector holder having a second opening for receiving the connector housing of the print-board connector, the print-board connector having a lock arm and a stopper on at least one surface of the connector housing, the lock arm coming into engagement with an outer edge of the second opening, and the stopper coming into contact with an inner face of the connector holder near an inner edge of the second opening when the front end of the connector housing is fit into the first opening.

9. The connector holding structure of claim 8, wherein the connector holder is a wall extending in parallel to a plane containing the first opening of the casing.

10. The connector holding structure of claim 8, wherein the lock arm comprises a flexible base portion extending in a direction of insertion of the connector housing, and a step formed at the trailing end of the base portion, the step catching the outer edge of the second opening.

11. The connector holding structure of claim 8, wherein the stopper consists of two or more projections, each having a contact area with the inner face of the connector holder.

12. The connector holding structure of claim 8, wherein the stopper is a rib having a contact area with the inner face of the connector holder.

13. The connector holding structure of claim 8, further comprising a positioning means on at least one surface of the connector housing, the positioning means preventing the print-board connector from shifting from a correct position.

14. The connector holding structure of claim 8, wherein the print-board connector is loaded on the printed circuit board in such a manner that a portion of the bottom face of the connector housing is mounted on the printed circuit board.

15. The connector holding structure of claim 8, wherein the casing has a pair of guide ribs on the inner face of two opposite walls, and the printed circuit board slides along the guide ribs in the direction of insertion of the print-board connector.

16. A connector holding structure comprising:

a print-board connector loaded on a printed circuit board, the print-board connector including a connector housing and a pair of levers that pivot about pivot axes;

a casing for accommodating the print-board connector and the printed circuit board, the casing having an opening for receiving the connector housing of the print-board connector, the connector housing having at least one grooves extending in a direction of insertion of the connector housing in the opening;

a counterpart connector fit into the print-board connector via the opening of the casing, the counterpart connector having at least one pin projection, the pin being received by and sliding along said at least one groove of the connector housing as the counterpart connector is being fit into the print-board connector; and a bracket holder for holding the counterpart connector and that defines recesses on both sides of the counterpart connector, a tip of each lever of the print-board connector being received and moving in the recess when the counterpart connector is fit into the print-board connector, the print-board connector having a lock arm and a stopper on at least one surface of the connector housing, the lock arm coming into engagement with an outer edge of the opening of the casing, and the stopper coming into contact with an inner face of the casing near an inner edge of the opening when the connector housing is fit into the opening.

* * * * *

UNITED STATES PATENT AND TRADEMARK OFFICE

CERTIFICATE OF CORRECTION

PATENT NO. : 6,547,591 B2 
DATED : April 15, 2003
INVENTOR(S) : Toshiaki Okabe and Masahiro Noda It is certified that error appears in the above-identified patent and that said Letters Patent is hereby corrected as shown below:

Column 10,
Line 28, "grooves" should read -- groove --.

Signed and Sealed this

Sixteenth Day of September, 2003

JAMES E. ROGAN
*Director of the United States Patent and Trademark Office*